United States Patent [19]

Fujimoto et al.

[11] 4,177,360

[45] Dec. 4, 1979

[54] MOVING MAGNET TYPE PICKUP CARTRIDGE

[75] Inventors: Yasuhiro Fujimoto; Masao Suzuki, both of Tokyo, Japan

[73] Assignee: Sansui Electric Co., Ltd., Tokyo, Japan

[21] Appl. No.: 819,282

[22] Filed: Jul. 27, 1977

[30] Foreign Application Priority Data

| | | | |
|---|---|---|---|
| Jul. 31, 1976 | [JP] | Japan | 51-91867 |
| Jul. 31, 1976 | [JP] | Japan | 51-91868 |
| Jun. 7, 1977 | [JP] | Japan | 52-67509 |

[51] Int. Cl.[2] ..... H04R 11/12

[52] U.S. Cl. ..... 179/100.41 M; 179/100.41 Z; 179/100.41 K

[58] Field of Search ..... 179/100.41 K, 100.41 M, 179/100.41 Z

[56] References Cited

U.S. PATENT DOCUMENTS

| | | | |
|---|---|---|---|
| 3,151,221 | 9/1964 | Pyke | 179/100.41 K |
| 3,526,728 | 9/1970 | Atsushiiga | 179/100.41 |
| 3,987,255 | 10/1976 | Kawakami et al. | 179/100.41 M |

*Primary Examiner*—Bernard Konick
*Assistant Examiner*—Donald E. McElheny, Jr.
*Attorney, Agent, or Firm*—Harris, Kern, Wallen & Tinsley

[57] ABSTRACT

A pickup cartridge is disclosed, which comprises a cantilever having one end provided with a stylus and the other end provided with an armature magnetized in the axial direction thereof, a yoke having at least three leg portions each having an end face, the end faces being faced to a peripheral side surface of the armature except a lower side surface portion thereof and a plurality of coils wound on at least two of the three leg portions and connected to detect only change of magnetic flux due to a desired slanted vibration of the armature.

12 Claims, 19 Drawing Figures

MOVING MAGNET TYPE PICKUP CARTRIDGE

BACKGROUND OF THE INVENTION

This invention relates to a magnetic circuit structure for a pick up cartridge of moving magnet type.

Hitherto, as a pick up cartridge of this type (this is referred to as a mere "cartridge," hereinafter), those shown in FIGS. 1 and 2 are known. A cartridge shown in FIG. 1 is constructed as follows. A flat armature 3 magnetized in the direction of its thickness is secured to one end of a cantilever 2 on the other end of which a phonograph needle 1 is mounted in such a manner that the armature is perpendicular to the axial direction of the cantilever 2, and this flat armature 3 is supported tiltably and oscillatably about a pivot 5 within a yoke 4. In inclination and oscillation of the flat armature (A condition that the armature is tilted and biased by oscillation to one side is shown with a imaginary line), the direction of a magnetic flux flowing through the yoke 4 is changed to induce a voltage in a coil 6 wounded on this yoke 4.

However, according to this structure shown in FIG. 1, the pole parts of said flat armature 3 is slighly moved in its oscillation relative to the yoke 4 and since the size of the yoke 4 facing the armature as compared with that thereof in the direction of its magnetized thickness, is long, a lot of invalidated magnetic flux $\phi_B$ not crossing the coil 6 in addition to an effective magnetic flux $\phi_A$ crossing the coil 6 is produced and thus it is difficult to obtain good sensitivity. On the other hand, a cartridge shown in FIG. 2 is constructed as follows. A yoke 7 having E shaped section is disposed so that the center pole $P_1$ thereof faces a flat armature 3 in static condition to leave a suitable space between it and the circumference of the armature 3. In inclination and oscillation of the flat armature 3 (A condition that it is tilted and biased by oscillation to one side is shown with an imaginary line), the circumference thereof approaches the front pole $P_2$ of the yoke 7 or the rear pole $P_3$ thereof, thereby causing the direction of a magnetic flux flowing through a part of the yoke on which a coil 6 is mounted to induce a voltage in the coil 6. In construction shown in FIG. 2, when the flat armature 3 is tilted and oscillated, one side of the pole in the circumference thereof approaches the center pole $P_1$ in a magnetically unbalanced condition, but since variation of the distance between the other pole and the front pole $P_2$ or the rear pole $P_3$ is small, efficiency of generation of electricity is not high.

Further, in constructions shown in FIGS. 1 and 2, since the combination of the coil 6 and the yoke 4 or 7 on which it is mounted are adapted to detect oscillation in one direction, independently, respectively, in order to apply the combination to a general 2-channel stereo system, it is necessary to prepare two such combinations each having the same construction with each other for a left channel and a right channel. Moreover, owing to structure of the pole surface and the like, the yokes 4 and 7 made of magnetic material, for example, Permalloy must be bent in a ]-shape in a direction of its thickness and thus the magnetic characteristic thereof is in danger of deteriorating. Accordingly, such conventional construction is not desired in production of a yoke, easiness in assembling it and homogeniousness in the characteristic and product thereof.

SUMMARY OF THE INVENTION

An object of the invention is to provide magnetic circuit construction for a pick up cartridge of moving magnet type having good electric and magnetic characteristic.

Another object of the invention is to provide a magnetic circuit construction for a pick up cartridge of moving magnet type having simple structure and capable of being made easily.

A further object of the invention is to provide an electric and magnetic construction for a pick up cartridge of moving magnetic type having high efficiency of generating of electricity.

Another object of the invention is to provide a pick up cartridge of the moving magnet type having a construction permitting the thickness of an armature part to be very thin.

Another object of the invention is to provide a pick up cartridge of moving magnet type wherein the size of an electric and magnetic circuit part is very small.

A further object of the invention is to provide a pick up cartridge of moving magnet type having a lightened oscillating system.

Another object of the invention is to provide a pick up cartridge of moving magnet type having good frequency characteristic and mechanical impedance characteristic.

Another object of the invention is to provide a pick up cartridge of moving magnet type having large freedom in selecting a perpendicular tracking angle.

A still further object of the invention is to provide a pick up cartridge of moving magnet type wherein an oscillating system may be mounted thereon and taken out therefrom.

A further object of the invention is to provide an electric and magnetic construction for a pick up cartridge of moving magnetic type wherein a cross-talk between a left and right channels may be very small.

DETAILED DESCRIPTION OF THE PREFERRED EMBODIMENTS

Figure 3:
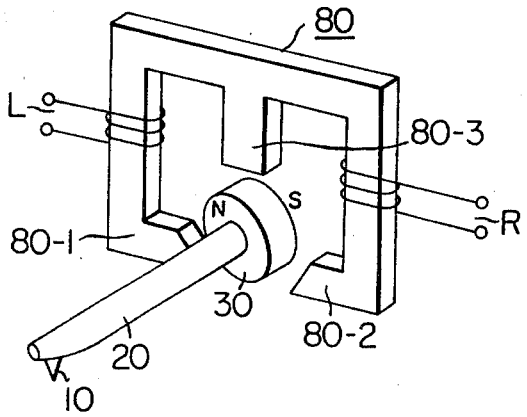
FIG. 3 is a perspective view of an embodiment of this invention.

FIG. 3 is a perspective view showing an embodiment of the invention. In FIG. 3, a flat armature 30 of circular plate type magnetized in the direction of its thickness is secured to one end of a cantilever 20 on the other end of which a phonograph needle 10 is mounted, so that it has the north pole at its front end and extends in a direction perpendicular to the axial direction of the cantilever 20. The flat armature 30 is supported through a suitable damper (not shown) to make it tiltable and oscillatable at a mid point on a center axis as its fulcrum, thereby it being at the shown static position. Further, a yoke 80 having three leg portions 80-1, 80-2 and 80-3 which are thinner than the thickness (a size in its magnetized direction) of the flat armature 30, is disposed on the same plane as a plane extending from the flat armature 30 at the static position or a plane being parallel to it and above the flat armature 30. The pole surfaces at the top ends of both side leg portions 80-1 and 80-2 of this yoke 80 are faced to each other, leaving a suitable space between each of said leg portions and each side of the circumference of said flat armature 30, respectively. These left and right side leg portions 80-1 and 80-2 are provided with a L side coil L and a R side coil R for deriving a L channel signal and a R channel signal responsive to oscillation of the phonograph needle 10, respectively.

As to a winding manner of the coil, it is desired to employ such a structure that an induced signal can be cancelled except that corresponding to tilting and oscillation of the armature 30 based on oscillation of the phonograph needle 10. Therefore, it is desired to derive a summation signal by adding coils L and R in FIG. 3 to coils $L_1$ and $R_1$ in the side leg portions 80-1 and 80-2, and further providing coils $L_2$ and $R_2$ in the center leg portion 80-3 as shown in FIG. 4A.

Figure 4A:
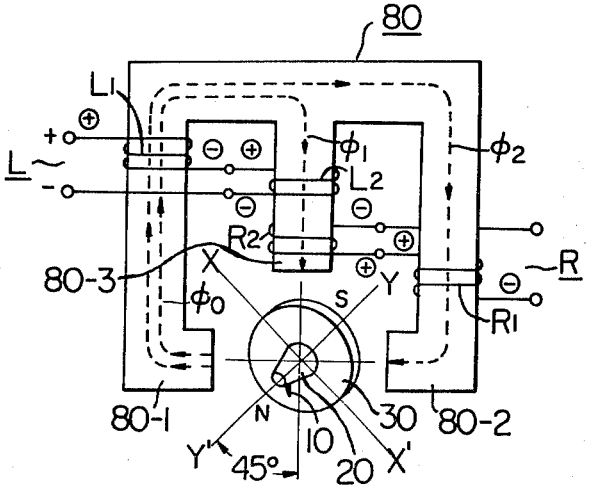
FIGS. 4A and 4B are diagrams for explaining a generating mechanism of electricity in a modified example of the embodiment shown in FIG. 3.
Figure 4B:
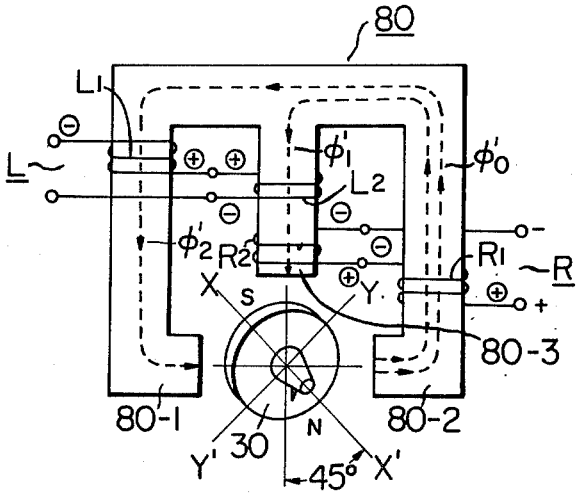

A generating mechanism in an embodiment of the invention wherein a coil arrangement in FIG. 4A is used, may be explained by referring to the same figure and FIG. 4*b*.

Now, if the flat armature 30 is tilted and biased from the static position in FIG. 3 to a Y' direction angled 45° a direction perpendicular to a reference plane (a record plate surface) relative to a shown line X–X', the north pole of the flat armature 30 approaches the top end pole surface of the left side leg portion 80-1 in the yoke 80 and the south pole thereof approaches the respective top end pole surface of the center leg portion 80-3 and the right side leg portion 80-2, so that the magnetic fluxes $\phi_0$, $\phi_1$ and $\phi_2$ occurs in the yoke as shown in FIG. 4*a*. (Where $\phi_0 \approx \phi_1 + \phi_2$) In this case, turn ratios of said coils $R_1$, $R_2$, $L_1$ $$NR_1(d\phi_2/dt) = NR_2(d\phi_1/dt)$$

$$NL_1(d\phi'_2/dt) = NL_2(d\phi'_1/dt)$$

and $L_2$ are determined to sutisfy the above equation (Where $NR_1$, $NR_2$, $NL_1$ and $NL_2$ are the turn number of said coils, respectively.)

Accordingly, voltages each having the shown polarity are induced in the coil $L_1$ mounted on the left leg portion 80-1 and in the coils $L_2$ mounted on the center leg portion 80-3 and the summation of these voltages is derived from the left side coil L as a voltage proportional to the variation of the magnetic flux due to tilting and oscillation of the flat armature 30 relative to the line X–X' as an axis. On the other hand, voltages each having the shown polarity are induced in the coil $R_1$ mounted on the right side leg portion 80-2 of the yoke 80 and in the coil $R_2$ mounted on the center leg portion 80-3 thereof but since coils $R_1$ and $R_2$ are adapted to cancel these induced voltages, a voltage is not induced in the right side coil R by inclination and oscillation of the flat armature 30 relative to the line X–X' as an axis.

On the contrary, if the flat armature 30 is tilted and biased from the condition shown in FIG. 3 to the X' direction crossing a direction perpendicular to the reference plane relative to a line Y–Y' as an axis at an angle 45°, the north pole of the flat armature 30 approaches the top end pole surface of the right leg portion 80 in the yoke 80 and the south pole of the flat armature 30 approaches said top end pole surfaces of the left side leg part 80-1 and the center leg part 80-3, so that magnetic fluxes $\phi_0$, $\phi_1$ and $\phi'_2$ occur in the shown direction and voltages induced in the coils $R_1$ and $R_2$ are added but voltages induced in the coils $L_1$ and $L_2$ are cancelled. As a result, a voltage proportional to the variation of the magnetic flux due to inclination and oscillation of the flat armature 30 relative to the line X–X' as an axis is induced but a voltage is not induced in the left side coil L by said inclination and oscillation.

Figure 5A:
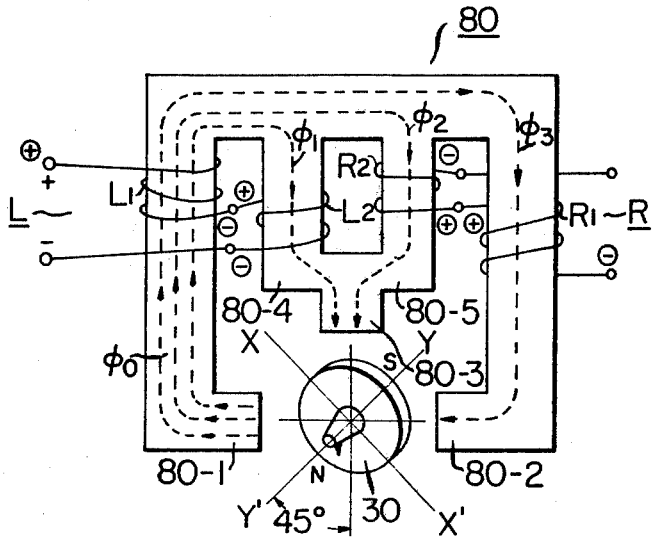
FIGS. 5A and 5B are diagrams for explaining a second embodiment of the invention and its generating mechanism of electricity.
Figure 5B:
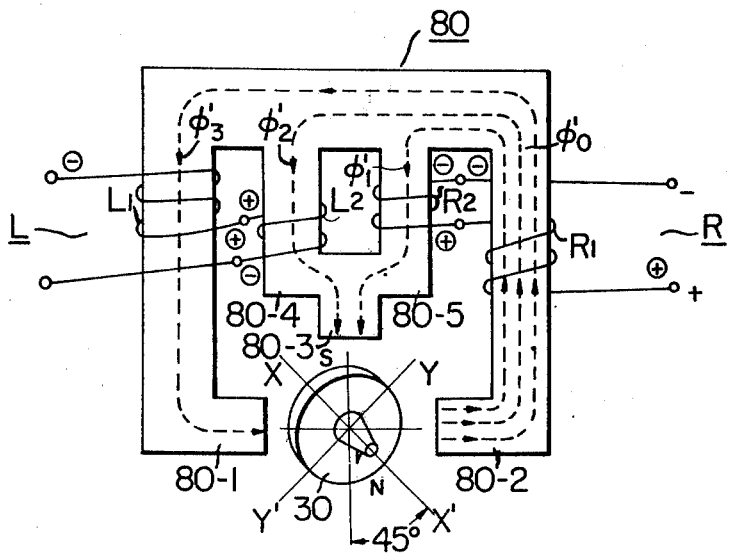

FIGS. 5A and 5B show another embodiment of this invention which has a similar construction to those of FIGS. 4A and 4B, but of which central leg portion 80-3 has branched portions forming leg portions 80-4 and 80-5 respectively. The leg portions 80-4 and 80-5 have coils $L_2$ and $R_2$ wound therearound, respectively. In this case, if the armature 30 is tilted and shifted in the Y' direction angled 45° with respect to the vertical direction to the reference plane (the record disc surface) about the axis of the X–X' direction, then, as shown in FIG. 5A, fluxes $\phi_0$, $\phi_1$, $\phi_2$ and $\phi_3$ are generated in the yoke 80, and in contrast with this, if the armature is tilted in the X' direction making an angle of 45° about the axis of the Y–Y' line, then, as shown in FIG. 5B, fluxes $\phi_0'$, $\phi_1'$, $\phi_2'$ and $\phi_3'$ are generated.

Therefore, in this case also, when the turn ratio is set as follows;

$$NR_1 \cdot d\phi_3/dt = NR_2 \cdot d\phi_2/dt$$

$$NL_1 \cdot d\phi'_3/dt = NL_2 \cdot d\phi_2'/dt$$

the summation voltage is produced only at the L-side output in the state of FIG. 5A and it is produced only a R-side output in the state of FIG. 5B.

Figure 6:
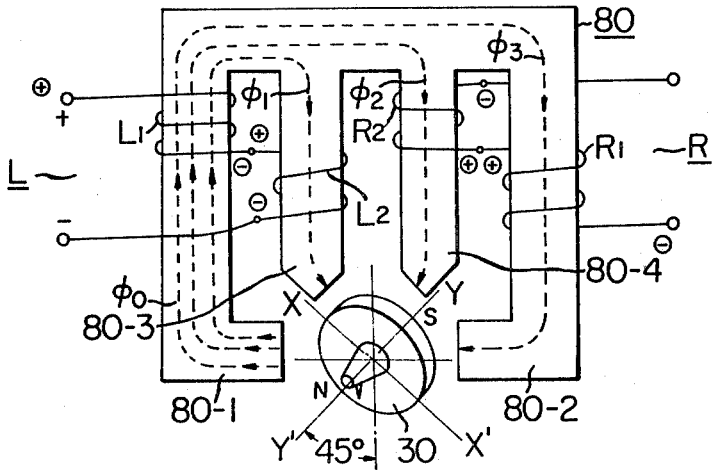
FIG. 6 is a diagram for explaining a third embodiment of the invention and its generating mechanism of electricity.

FIG. 6 shows the third embodiment of this invention. The embodiment of FIG. 6 is substantially similar one of that of FIGS. 5A and 5B, but it differs therefrom the point that the branched portions of the central leg portion 80-3 in the embodiment of FIG. 5 are not interjoined at the free end portion of the leg portion 80-3, but extend as they are. In the embodiment of FIG. 6, the provision of the coils is easy in comparison with the case of the embodiment of FIG. 5.

Figure 1:
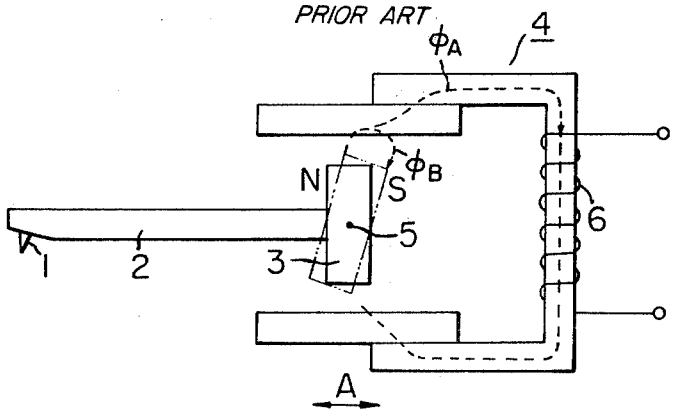
FIG. 1 PRIOR ART
FIG. 1 is a schematic view showing example of an oscillating system and a generating system of electricity in a conventional pick up cartridge of moving magnet type.
Figure 2:
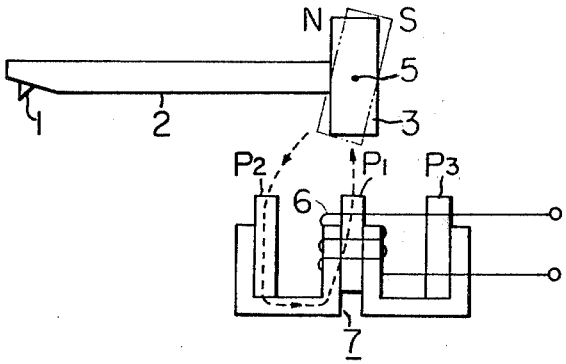
FIG. 2 PRIOR ART
FIG. 2 is a schematic diagram showing other example of an oscillating system and a generating system of electricity in a conventional pick up cartridge of moving magnet type.
Figure 7:
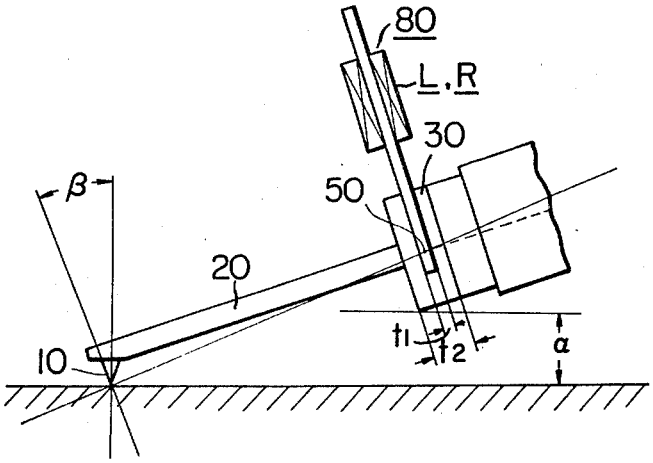
FIG. 7 is a side view as to each of the first, second and third embodiments of the invention.

The cartridge of the constructions above based on the generation principal of electricity as set force is advantageous in the light of its quality and its making up. That is to say, since the thickness $t_1$ of the leg portions, three in the embodiment of FIGS. 3 and 4 and four in the embodiments of FIGS. 5 and 6, of the yoke 80 arranged around the circumferential edge of the flat armature 30 as described above is set more thick than the thickness $t_2$ of the flat armature 30 magnetized in the direction of the thickness as shown in the side view of FIG. 7, there is small generation of ineffective fluxes in comparison with the conventional construction (for example, FIG. 1), and since for small shift or deflection of the flat armature 30 some difference of magnetic potential between the leg portions of the yoke 80, high efficiency of the electricity generation is obtainable. Further, in this case, since it has such a construction that the distance between the flat armature 30 and the legs of the yoke 80 can be easily set narrow, the efficiency of the electricity generation can be increased correspondently. Also, because of high efficiency of the electricity generation, the flat armature 30 can be made further thick and small in size, so that the vibration system can be made right and improved frequency characteristic and mechanical impedance characteristic can be provided. Also, since the cartridge of this invention is so constructed that there is no portion of the yoke extending downward (to the record disc side) beyond the flat armature 30, it can provide wide distance ($\alpha$) between the lower side of the electricity generating part and the face of the record disc as shown in FIG. 7, whereby the design of vertical tracking angle $\beta$ is easy, and, also, making the vibration system light is easy by shortening the length of the cantilever 20. Furthermore, by properly setting the turn numbers of the coils $L_2$ and $R_2$ wound around the central leg portions 80-3, 80-4 and 80-5 of the yoke 80, the cross talk valve which would be produced between the L and R channels can be improved, and they can selected at will within a predetermined extent.

Since a magnetic path in the yoke 80 can be shortened and the bending process for the yoke 80 is not needed, magnetic loss decreases. In particular, since the bending process is not needed according to the above construction, lamination of the yoke portion, is easily effected and it is easily attained to improve the frequency characteristic of the magnetic circuit. Further, since the yoke 80 is not disposed below the flat armature 30, in exchanging the oscillating system, exchange from the lower side thereof is possible in addition to exchange from the front in a conventional manner, and exchange of the oscillating system, namely, exchange of the phonograph needle can be simplified.

Moreover, since spaces between parts of leg portions 80-1–80-5 in the yoke 80 on which coils are mounted can be expanded, winding work can be simplified. Hitherto, in two channel stereo cartridge, one yoke for a left channel and one yoke for a right channel, independently, respectively, these two yokes are needed but according to the above construction only one set is needed as the yoke 80, which is effective in manufacturing the yoke 80 and in assembling the cartridge and thus their manufacturing cost can be reduced. In addition, there are various effects resulting from small size, light weight, simple construction, etc.

Figure 8:
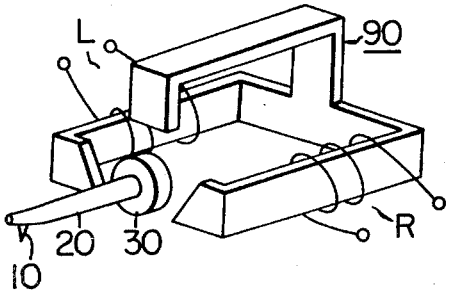
FIGS. 8, 9 and 10 are diagrams showing modified examples of the first embodiment of this invention.
Figure 9:
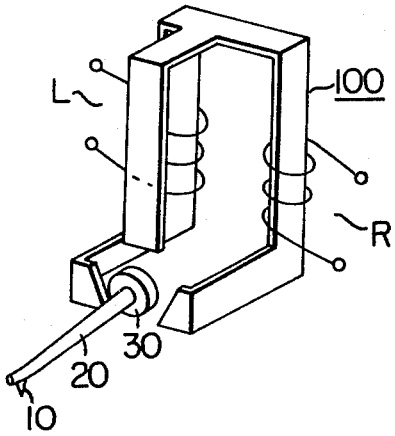
Figure 10:
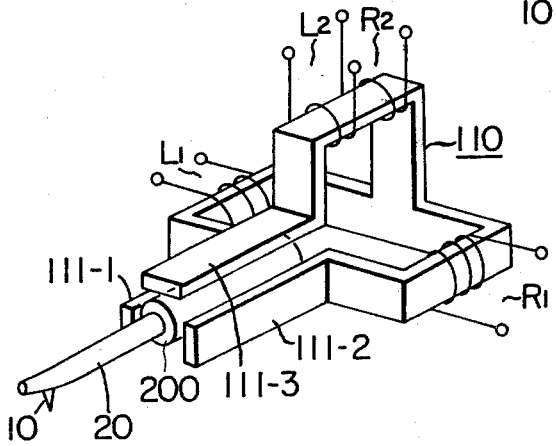
Figure 11:
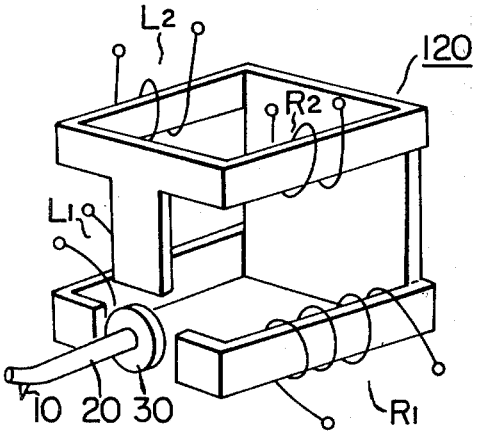
FIGS. 11, 12 and 13 are diagrams showing modified examples of the second embodiment of this invention.
Figure 12:
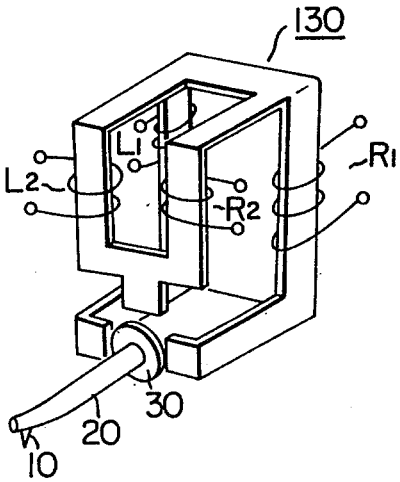
Figure 13:
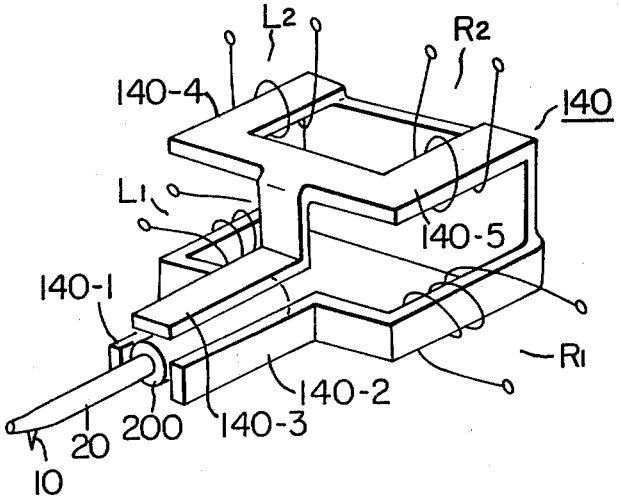
Figure 14:
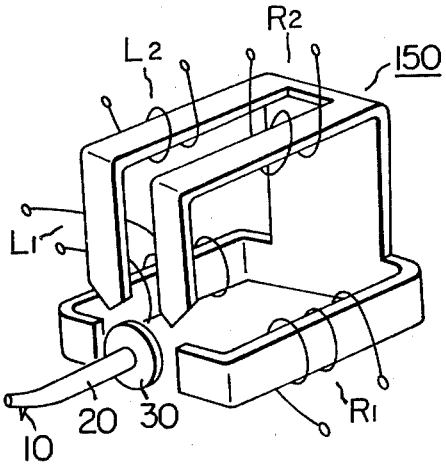
FIGS. 14, 15 and 16 are diagrams showing modified examples of the third embodiment of this invention.
Figure 15:
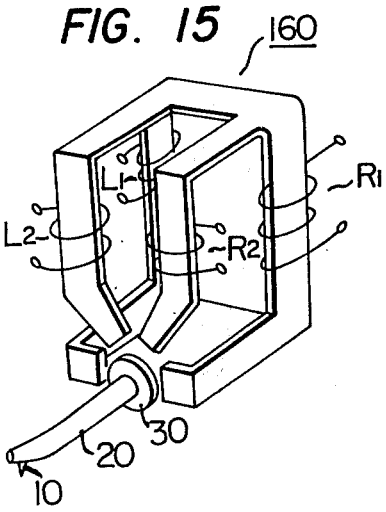
Figure 16:
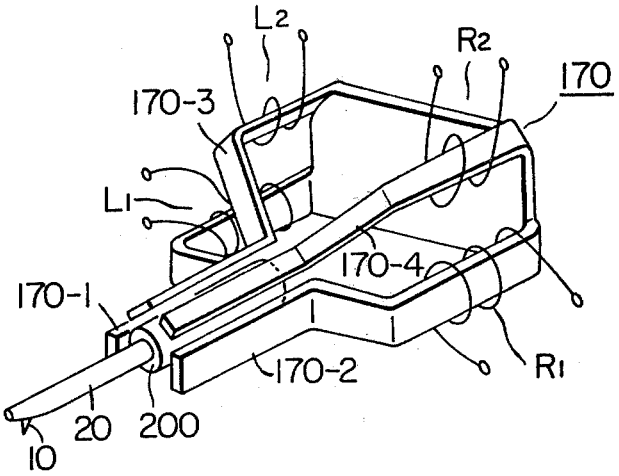
Figure 17A:
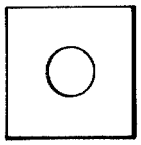
FIGS. 17(*a*) to 17(*d*) are elevation views of various armatures in other embodiments which can be used in the invention.
Figure 17B:
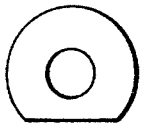
Figure 17C:
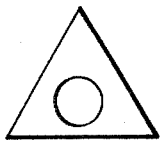
Figure 17D:
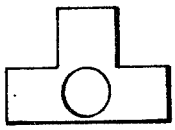

In the above embodiment, the yoke 80 having three or four leg portions whose thickness is thinner than that of the armature 30 (a size in a magnetized direction) is disposed in a direction perpendicular to the magnetized direction of the armature 30. However, also, this may be satisfied by using, for example, yokes 90, 100, 110 as shown in FIGS. 8 to 10 corresponding to those in the first embodiment, or yokes 120, 130, 140 as shown in FIGS. 11 to 13 as to the second embodiment. Further, as to the third embodiment, yokes 150, 160, 170 as shown in FIGS. 14 to 16 may be employed. In embodiments shown in FIGS. 10, 13 and 16, an armature of bar type may be substituted for the flat armature 30 of circular plate type. In this case it is desired that the length of the armature 200 is slightly shorter than that of the pole surface facing the top end of the leg portion (110-1–110-3 in FIG. 10, 140-1–140-3 in FIG. 13, 170-1–170-4).

Besides, the shape of an armature may be square shape as shown in FIG. 17(*a*), about half circle shape as shown in FIG. 17(*b*), about triangle shape as shown in FIG. 17(*c*) and about T shaped configuration as shown in FIG. 17(*d*) as well as the circular shape.

Moreover, this invention can be variously modified and embodied within the range of not altering the gist thereof.

As described above in a detailed manner, according to the invention, it is possible to provide a cartridge wherein its generating efficiency of electricity is high, its electrical and magnetic characteristic is good, its construction is simple and its manufacture is easy.

What is claimed is:

1. A pickup cartridge of the moving magnet type, comprising (a) a stationary yoke having at least three leg portions;

(b) an armature;

(c) means including a tiltably and oscillatably movable cantilever connected at one end with said armature for normally supporting said armature in a static position adjacent said yoke leg portions, said yoke leg portions being disposed in a plane normal to the axis of said cantilever when in the static position, a pair of said yoke leg portions comprising side leg portions arranged on left and right sides of said armature, respectively, the remaining yoke leg portions being arranged solely above said armature, whereby the area beneath said armature is open;

(d) a phonograph needle connected with the other end of said cantilever for tilting and oscillating the same;

(e) a pair of first coil means wound on said side leg portions, respectively, to provide channel signals in accordance with the inclination and oscillation of said armature based on oscillation applied to said phonograph needle; and (f) a pair of second coil means electrically connected with said first coil means, respectively, said second coil means being wound on those leg portions of said yoke arranged between said yoke side leg portions in such a manner as to cancel the voltages induced in one yoke side leg portion when the cantilever is tilted in one direction from said static position;

(g) the end portions of said side leg portions adjacent said armature being disposed so that variation of magnetic flux, except that corresponding to inclination and oscillation of the armature based on oscillation applied to the phonograph needle, is cancelled magnetically.

2. A pick up cartridge according to claim 1 wherein the end surfaces of said end portions face to said armature.

3. A pick up cartridge according to claim 1 wherein side surfaces of said end portions face to said armature.

4. A pick up cartridge according to claim 1 wherein said center leg part is formed by two branch legs on which said pair of coils are mounted, and the end surfaces of said end portions face to said armature.

5. A pick up cartridge according to claim 1 wherein said center leg part is formed by two branch legs on which said pair of coils are mounted, and side surfaces of said end portions face to said armature.

6. A pick up cartridge according to claim 1 further including a pair of coils mounted on the center leg portions of said at least three leg portions, said pair of coils being coupled with the coils mounted on said side leg portions so that induced signals except induced signals corresponding to inclination and oscillation of said armature based on oscillation applied to said phonograph needle are cancelled and the induced signals corresponding to inclination and oscillation are added.

7. A pick up cartridge according to claim 6 wherein said center leg portion is formed by two branch legs on which said pair of coils are mounted.

8. A pick up cartridge according to claim 6 wherein the end surfaces of said end portions face to said armature.

9. A pick up cartridge according to claim 6, wherein side surfaces of said end portions face to said armature.

10. A pick up cartridge according to claim 6, wherein a mid portion of said center leg portion is formed by two branch magnetic paths on which said pair of coils are mounted.

11. A pick up cartridge according to claim 10 wherein a mid portion of said center leg part is formed by two branch magnetic paths on which said pair of coils are mounted, and the end surfaces of said end portions face to said armature.

12. A pick up cartridge according to claim 10 wherein a mid portion of said center leg part is formed by two branch magnetic paths on which said pair of coils are mounted, and side surfaces of said end portions face to said armature.

* * * * *